US007038385B2

(12) United States Patent
Takagaki et al.

(10) Patent No.: US 7,038,385 B2
(45) Date of Patent: May 2, 2006

(54) MERCURY-FREE ARC TUBE FOR DISCHARGE LAMP UNIT

(75) Inventors: Michio Takagaki, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 141 days.

(21) Appl. No.: 10/253,577

(22) Filed: Sep. 25, 2002

(65) Prior Publication Data

US 2003/0062839 A1 Apr. 3, 2003

(30) Foreign Application Priority Data

Sep. 28, 2001 (JP) ..... P.2001-299237
Aug. 23, 2002 (JP) ..... P.2002-243879

(51) Int. Cl.
*H01J 17/04* (2006.01)

(52) U.S. Cl. ..... 313/631; 313/620; 313/638; 313/570

(58) Field of Classification Search ..... 313/567, 313/631, 637, 638, 620, 491
See application file for complete search history.

(56) References Cited

U.S. PATENT DOCUMENTS

| | | | | |
|---|---|---|---|---|
| 5,081,396 | A * | 1/1992 | Schneider et al. | 313/630 |
| 5,402,037 | A | 3/1995 | Irisawa et al. | |
| 6,294,861 | B1 | 9/2001 | Mochiduki et al. | |
| 6,353,289 | B1 * | 3/2002 | Ishigami et al. | 313/637 |
| 6,639,343 | B1 * | 10/2003 | Takashi et al. | 313/161 |
| 2002/0158580 | A1 * | 10/2002 | Uemura et al. | 313/634 |

* cited by examiner

*Primary Examiner*—Mariceli Santiago
*Assistant Examiner*—German Colón
(74) *Attorney, Agent, or Firm*—Sughrue Mion, PLLC

(57) ABSTRACT

A mercury-free arc tube for a discharge lamp unit including a closed glass bulb and a pair of electrode rods provided in the closed glass bulb so as to be opposite to each other. The closed glass bulb does not contain mercury as in the related art arc tubes, but contains main light emitting metal halide and starting rare gas enclosed in the closed glass bulb. In accordance with necessity, predetermined buffer metal halide in place of mercury may be enclosed to suppress the lowering of the tube voltage to some extent. In addition, the tube current I is increased to make the tube voltage high. The tube current I (unit: A) and the outer diameter d (unit: mm) of each electrode rod are set to have a relationship of $1.0 \leqq I/d \leqq 5.0$. As a result, though such an increased tube current is used, the electrode temperature is kept in optimum temperature.

6 Claims, 9 Drawing Sheets

FIG. 2

EVALUATION IN OPERATION FOR 1,500 HOURS BY BLINKING IN EU CAR MAKER MODE (n = 5 FOR EACH KIND)

| I/d (A/mm) | 0.5 | 1.0 | 1.5 | 2.0 | 2.5 | 3.0 | 3.5 | 4.0 | 4.5 | 5.0 | 5.5 | 6.0 |
|---|---|---|---|---|---|---|---|---|---|---|---|---|
| OCCURRENCE OF CRACKS IN GLASS | 0/5 ○ | 0/5 ○ | 0/5 ○ | 0/5 ○ | 0/5 ○ | 0/5 ○ | 0/5 ○ | 0/5 ○ | 0/5 ○ | 0/5 ○ | 1/5 △ | 5/5 × |
| OCCURRENCE OF FADING-OUT | 5/5 × | 2/5 △ | 2/5 △ | 1/5 △ | 1/5 △ | 0/5 ○ | 0/5 ○ | 0/5 ○ | 0/5 ○ | 0/5 ○ | 0/5 ○ | 0/5 ○ |
| ELECTRODE DEFORMATION | 0/5 ○ | 0/5 ○ | 0/5 ○ | 0/5 ○ | 0/5 ○ | 0/5 ○ | 0/5 ○ | 0/5 ○ | 0/5 ○ | 0/5 ○ | 5/5 × | 5/5 × |
| TURNING-BLACK | 0/5 ○ | 0/5 ○ | 0/5 ○ | 0/5 ○ | 0/5 ○ | 0/5 ○ | 0/5 ○ | 0/5 ○ | 0/5 ○ | 0/5 ○ | 2/5 △ | 5/5 × |
| LUMEN MAINTENANCE FACTOR (AVERAGE %) | 79 ○ | 78 ○ | 78 ○ | 75 ○ | 74 ○ | 75 ○ | 73 ○ | 72 ○ | 72 ○ | 70 ○ | 66 × | 60 × |

INFLUENCE OF RARE GAS CHARGED PRESSURE AND ELECTRODE DIAMETER (n = 5 FOR EACH KIND)

| P x d | 1.5 | 2.0 | 2.5 | 3.0 | 3.5 | 4.0 | 4.5 | 5.0 | 5.5 | 6.0 | 6.5 |
|---|---|---|---|---|---|---|---|---|---|---|---|
| ELECTRODE DEFORMATION | 4/5 × | 2/5 △ | 0/5 ○ | 0/5 ○ | 0/5 ○ | 0/5 ○ | 0/5 ○ | 0/5 ○ | 0/5 ○ | 0/5 ○ | 0/5 ○ |
| FADING-OUT | 0/5 ○ | 0/5 ○ | 0/5 ○ | 0/5 ○ | 0/5 ○ | 0/5 ○ | 0/5 ○ | 0/5 ○ | 2/5 △ | 3/5 △ | 5/5 × |

FIG. 7

EVALUATION IN OPERATION FOR 1,500 HOURS BY BLINKING IN EU CAR MAKER MODE (n = 5 FOR EACH KIND)

| I/V ($A/mm^3$) | 0.1 | 0.2 | 0.5 | 1.0 | 2.0 | 5.0 | 10 | 25 | 50 | 75 | 100 |
|---|---|---|---|---|---|---|---|---|---|---|---|
| OCCURRENCE OF FADING-OUT | 5/5 × | 2/5 △ | 2/5 △ | 0/5 ○ | 0/5 ○ | 0/5 ○ | 0/5 ○ | 0/5 ○ | 0/5 ○ | 0/5 ○ | 0/5 ○ |
| ELECTRODE DEFORMATION | 0/5 ○ | 0/5 ○ | 0/5 ○ | 0/5 ○ | 0/5 ○ | 0/5 ○ | 0/5 ○ | 0/5 ○ | 1/5 △ | 2/5 △ | 5/5 × |
| TURNING-BLACK | 1/5 △ | 0/5 ○ | 0/5 ○ | 0/5 ○ | 0/5 ○ | 0/5 ○ | 0/5 ○ | 2/5 △ | 1/5 △ | 2/5 △ | 4/5 × |
| LUMEN MAINTENANCE FACTOR (AVERAGE %) | 77 ○ | 77 ○ | 78 ○ | 76 ○ | 76 ○ | 75 ○ | 74 ○ | 71 ○ | 71 ○ | 70 ○ | 66 × |

MERCURY-FREE ARC TUBE FOR DISCHARGE LAMP UNIT

BACKGROUND OF THE INVENTION

1. Field of the Invention

The present invention relates to an arc tube for a discharge lamp unit, and more particularly to a mercury-free arc tube for a discharge lamp unit which does not contain mercury, but rather, contains main light emitting metal halide and starting rare gas enclosed in a closed glass bulb.

2. Description of the Related Art

FIG. 9 shows a discharge bulb which is a related-art discharge lamp unit used as a light source of an automotive lamp. The discharge bulb has a structure in which an arc tube 2 having a closed glass bulb 2*a* as a light emitting portion is integrated with an electrically insulating plug body 1 made of a synthetic resin. A rear end portion of the arc tube 2 is gripped by a metal support member 8 fixed to the electrically insulating plug body 1. A front end portion of the arc tube 2 is supported by a metal lead support 9 which serves also as a current conduction path extended out from the electrically insulating plug body 1.

The arc tube 2 has a structure in which main light emitting metal halide, buffer mercury and starting rare gas are enclosed in the closed glass bulb 2*a* which is held between pinch seal portions 2*b* and 2*b* located at opposite ends of the close glass bulb 2*a,* and which is provided with a pair of electrode rods 3 and 3 so as to be opposite to each other. Light is emitted on the basis of arc generated by electric discharge between the electrode rods 3 and 3. The discharge bulb is superior to that of an incandescent bulb because a large quantity of emitted light, a long lifetime, etc. can be achieved by the discharge bulb. For this reason, nowadays there is a tendency for this type of discharge bulb to be used as a light source for a head lamp or a fog lamp of an automobile.

The reference numeral 4 designates a lead wire led out from each pinch seal portion 2*b*. The reference numeral 5 designates a sheet of molybdenum foil for connecting the lead wire 4 to a corresponding tungsten electrode rod 3. Further, ultraviolet-shielding shroud glass 6 is integrally welded to the arc tube 2 to thereby form a structure in which the closed glass bulb 2*a* is surrounded by a closed space formed by the shroud glass 6. Hence, the inside of the closed glass bulb 2*a* is kept at a high temperature while ultraviolet rays in a wavelength range harmful to the human body are cut-off from light emitted from the arc tube 2.

Mercury enclosed in the related-art closed glass bulb 2*a* is a substance toxic to the environment. In response to the social needs of reducing the cause of global environmental pollution as much as possible, it is desirable that a mercury-free arc tube is developed.

The following findings have been obtained in the process of research and development on a mercury-free arc tube not containing mercury.

Mercury acts mainly as a buffer substance for keeping the tube voltage constant to reduce the amount of electrons colliding with electrodes to thereby buffer the damage of the electrodes. Therefore, when mercury is removed from the substances enclosed in the closed glass bulb, the tube voltage is reduced. That is, the tube power required for electric discharge cannot be obtained. It is therefore necessary to increase a tube current to increase the tube power. Thus, the load on each electrode increases (current density increases) correspondingly, so that the temperature of the electrode increases. With this temperature increase, the following problems occur.

First, the electrode is deformed by heat, or the glass bulb turns black near the root of the electrode by sputtering in the electrode surface, or the electrode is deformed because the chemical reaction between tungsten as an electrode constituent material and the enclosed substance (halide) proceeds in the electrode surface. Thus, the lumen maintenance factor (life performance) is lowered. In addition, the electrode is consumed so that the arc fades out. Further, the glass is cracked due to the difference in coefficient of thermal expansion between the electrode and the glass.

SUMMARY OF THE INVENTION

The present inventors researched use of metal halide acting as a buffer in place of mercury. Metal halide effective in increasing the tube voltage to some extent was indeed found, but metal halide acting as a buffer equivalent to that of mercury was not found. That is, when this new buffer metal halide is simply enclosed in place of mercury, a tube voltage necessary and sufficient for electric discharge cannot easily (or sometimes never) be obtained. Therefore, the present inventor intended to avoid an increase of temperature in the electrodes (or problems caused by the increase of temperature) on the condition that an arc tube is used with an increased tube current.

Then, the electrode temperature is proportional to the current density and the electrode surface area. Accordingly, when each electrode rod is formed to have a uniform thickness, the electrode temperature T (unit: °C.) is expressed by $T=k_1(4I/\pi d^2)\pi dL=k_1LI/d$ where d (unit: mm) designates the outer diameter of each electrode rod, L (unit: mm) designates the projecting length of the electrode rod into the closed glass bulb, I (unit: A) designates the magnitude of the tube current, and $k_1$ designates a proportionality factor. That is, when the projecting length L of the electrode rod into the closed glass bulb is constant, the electrode temperature T can be specified by the ratio I/d (unit: A/mm) of the magnitude I of the tube current to the outer diameter d of the electrode rod.

For example, when a spherical portion having a larger diameter than the shaft diameter is formed at the front end of an electrode rod, the electrode rod is not formed to have a uniform thickness. In such a case, the relationship of $T=4k_1LI/d$ is not established. Therefore, the inventor paid attention to the volume of an electrode for the case where its electrode rod is not formed to have a uniform thickness. That is, the heat capacity of the electrode depends largely on the volume of the electrode. When the volume of the electrode is small, the heat capacity of the electrode is small so that there arises a problem that the electrode is deformed or the glass bulb turns black. On the contrary, the larger the volume that the electrode is, the larger the heat capacity is. In this case, it is difficult to damage the electrode even when the tube current increases. However, when the volume of the electrode is too large, the electrode temperature drops so that the arc fades out. The electrode temperature is proportional to the tube current, but inversely proportional to the electrode volume. Accordingly, the electrode temperature T (unit: °C.) satisfies the relationship of $T=k_2I/V$ where V (unit: $mm^3$) designates the volume of the electrode rod in the closed glass bulb, I (unit: A) designates the magnitude of the tube current, and $k_2$ designates a proportionality factor. That is, the electrode temperature T can be specified by the ratio I/V (unit: A/mm$^3$) of the tube current magnitude I to the electrode rod volume V.

Then, the inventors performed an operational test on each arc tube while changing the tube current magnitude I and the electrode rod outer diameter d in the case where the arc tube had electrode rods each having a uniform thickness, and an operational test on each arc tube while changing the tube current magnitude I and the electrode rod volume V in the case where the arc tube had electrode rods each not having a uniform thickness, but having a large spherical portion located at their front end. Thus, the inventor made an investigation as to whether the problems caused by the increase of temperature in the electrodes occurred or not and whether the arc faded out or not. As a result, it was confirmed that the problems of the arc fading-out did not occur when the ratio I/d of the tube current magnitude I to the electrode rod outer diameter d (or the ratio I/V of the tube current magnitude I to the electrode rod volume V) stayed in a predetermined range. Thus, the inventor proposed Unexamined Japanese Patent Application No. 2001-299237 (Mercury-Free Arc Tube Having Main Light Emitting Halide, Buffer Metal Halide and Starting Rare Gas Enclosed in Closed Glass Bulb), on which the present invention is based.

The inventors also performed other experiments. As a result, it was confirmed that even if buffer metal halide was not enclosed in a closed glass bulb, characteristics close to the characteristics of a related-art mercury-containing arc tube could be obtained by adjusting the charged pressure of rare gas or the charged quantity or ratio of main light emitting metal halide enclosed in the closed glass bulb. Therefore, the inventor has also proposed Unexamined Japanese Patent Application No. 2002-243879, on which the present invention is based as well.

The invention was developed on the basis of the related-art problems and the knowledge of the inventors. It is an object of the invention to provide a mercury-free arc tube for a discharge lamp unit which can obtain characteristics substantially equivalent to or better than the characteristics of the related-art arc tube by using an increased tube current while making an electrode temperature not too high.

(1) In order to attain the foregoing object, when an arc tube has electrode rods each formed to have a uniform thickness, the mercury-free arc tube for a discharge lamp unit includes: a closed glass bulb held between pinch seal portions located at opposite ends of the close glass bulb; and a pair of electrode rods provided in the closed glass bulb so as to be opposite to each other, the closed glass bulb containing main light emitting metal halide and starting rare gas enclosed in the closed glass bulb, wherein an outer diameter d (unit: mm) of each of the electrode rods and a tube current I (unit: A) supplied to the electrode rods satisfy a relationship of $1.0 \leqq I/d \leqq 5.0$ (unit: A/mm).

(2) When an arc tube has electrode rods each formed not to have a uniform thickness, the mercury-free arc tube for a discharge lamp unit includes: a closed glass bulb held between pinch seal portions located at opposite ends of the close glass bulb; and a pair of electrode rods provided in the closed glass bulb so as to be opposite to each other, the closed glass containing main light emitting metal halide and starting rare gas enclosed in the closed glass bulb, wherein a volume V (unit:mm$^3$) of each of the electrode rods in the closed glass bulb and a tube current I (unit: A) supplied to the electrode rods satisfy a relationship of $1.0 \leqq I/V \leqq 10.0$ (unit: A/mm$^3$).

(3) Buffer metal halide, together with the main light emitting metal halide and the starting rare gas, may be enclosed in the closed glass bulb in either of the cases described in (1) and (2).

(Operation) As the main light emitting metal halide and the starting rare gas, sodium-scandium-based halide such as NaI and $ScI_3$ may be used as the former, and Xe may be used as the latter, in the same manner as in the related-art mercury-containing arc tube.

When buffer metal halide is enclosed in the closed glass bulb in place of mercury as in (3), the halide may comprise one or more halides including Al, Bi, Cr, Cs, Fe, Ga, In, Li, Mg, Ni, Nd, Sb, Sn, Ti, Tl, Tb and Zn as the buffer metal halide. When such buffer metal halide is enclosed in the closed glass bulb, the tube voltage is restrained, to some extent, from being reduced greatly due to no mercury enclosed in the closed glass bulb. It is desired that the charged quantity of the buffer metal halide be in a range of $3\times10^{-4}$ mg/μl to $2\times10^{-2}$ mg/μl.

In addition, when no buffer metal halide is enclosed in the closed glass bulb as in (1) or (2), the charged quantity or ratio of the main light emitting metal halide or the charged pressure of the starting rare gas enclosed in the closed glass bulb may be adjusted. Thus, the tube voltage is restrained, to some extent, from being reduced greatly due to no mercury enclosed in the closed glass bulb.

In addition, the electrode temperature is proportional to the current density and the electrode surface area. Therefore, when each of the electrode rods is formed to have a uniform thickness, the electrode temperature T (unit: C.°) is expressed by $T=k_1(4I/\pi d^2)\pi dL=k_1LI/d$ where d (unit: mm) designates the outer diameter of each electrode rod, L (unit: mm) designates the projecting length of the electrode rod into the closed glass bulb, I (unit: A) designates the magnitude of the tube current, and $k_1$ designates a proportionality factor. That is, when the projecting length L of the electrode rod into the closed glass bulb is constant, the electrode temperature T can be specified by the ratio I/d (unit: A/mm) of the magnitude I of the tube current to the outer diameter d of the electrode rod.

As for cracks produced in the glass, as shown in FIG. 2, no cracks occur when the ratio I/d is in a range of 0.5 to 5.0. Cracks may possibly occur when the ratio I/d is 5.5, and cracks surely occur when the ratio I/d is not lower than 6.0. On the other hand, as for arc fading-out, no arc fades out when the ratio I/d is in a range of 3.0 to 6.0. The arc may possibly fade out when the ratio I/d is in a range of 1.0 (inclusive) to 3.0 (exclusive). The arc surely fades out when the ratio I/d is not higher than 0.5. Further, as for the electrode deformation, no electrode deformation is observed when the ratio I/d is in a range of 0.5 to 5.0, but the electrodes are surely deformed when the ratio I/d is not lower than 5.5. Further, as for turning-black of the glass bulb, the glass bulb does not turn black at all when the ratio I/d is in a range of 0.5 to 5.0. The glass bulb may possibly turn black when the ratio I/d is 5.5, and surely turns black when the ratio I/d is not lower than 6.0. Further, as for the lumen maintenance factor, the average lumen maintenance factor is not lower than 70% when the ratio I/d is in a range of 0.5 to 5.0, while the average lumen maintenance factor takes a low value lower than 70% when the ratio I/d is not lower than 5.5.

Accordingly, to prevent the glass from being cracked, the arc from fading out, the electrodes from being deformed, the glass bulb from turning black, or the lumen maintenance factor from being lowered, it is desired that the ratio I/d is in a range of 1.0 to 5.0, preferably in a range of 3.0 to 5.0.

On the other hand, when a spherical portion having a larger diameter than the shaft diameter is formed at the front end of each electrode rod, the electrode rod is not formed to have a uniform thickness. In such a case, the relationship of $T=4k_1LI/d$ is not established. In such a case, however, the electrode temperature is proportional to the tube current, but inversely proportional to the electrode volume. Accordingly, the electrode temperature T (unit: °C.) satisfies the relationship of $T=k_2I/V$ where V (unit: $mm^3$) designates the volume of each electrode rod in the closed glass bulb, I (unit: A) designates the magnitude of the tube current, and $k_2$ designates a proportionality factor. That is, the electrode temperature T can be specified by the ratio I/V (unit: $A/mm^3$) of the tube current magnitude I to the electrode rod volume V.

As for arc fading-out, as shown in FIG. 7, no arc fades out when the ratio I/V is in a range of 1.0 to 100. The arc may possibly fade out when the ratio I/V is in a range of 0.2 (inclusive) to 1.0 (exclusive). The arc surely fades out when the ratio I/V is not higher than 0.1. Further, as for the electrode deformation, no electrode deformation is observed when the ratio I/V is in a range of 0.1 to 25, but any electrode may be possibly deformed when the ratio I/V is in a range of 50 (inclusive) to 100 (exclusive), and is surely deformed when the ratio I/V is not lower than 100. Further, as for turning-black of the glass bulb, the glass bulb does not turn black at all when the ratio I/V is in a range of 0.2 to 10. The glass bulb may possibly turn black when the ratio I/V is lower than 0.2 or in a range of 25 to 75, and the glass bulb surely turns black when the ratio I/V is not lower than 100. Further, as for the lumen maintenance factor, the average lumen maintenance factor is not lower than 70% when the ratio I/V is in a range of 0.1 to 75, but the average lumen maintenance factor takes a low value lower than 70% when the ratio I/V is not lower than 100.

Accordingly, to prevent the glass from being cracked, the arc from fading out, the electrodes from being deformed, the glass bulb from turning black, or the lumen maintenance factor from being lowered, it is preferable that the ratio I/V is in a range of 1.0 to 10.

(4) Further, in a mercury-free arc tube for a discharge lamp unit as defined in (1) or (3), charged pressure P (unit: atmosphere) of the starting rare gas enclosed in the closed glass bulb and an outer diameter d (unit: mm) of each of the electrode rods may satisfy a relationship of $2.0 \leqq Pd \leqq 6.0$, preferably a relationship of $2.5 \leqq Pd \leqq 5.0$.

(Operation) In (1) (when each electrode rod is formed to have a uniform thickness), the ratio I/d of the tube current I (unit: A) supplied to the electrode rods to the outer diameter d (unit: mm) of each electrode rod is limited to control the electrode temperature. On the other hand, in (4), the product Pd of the rare gas charged pressure P (unit: atmosphere) and the electrode rod outer diameter d (unit: mm) is limited to control the electrode temperature.

That is, the tube power is proportional to the tube voltage and the tube current, and the tube voltage and the charged pressure of the starting rare gas in the closed glass bulb have a correlation (proportionality) as shown in FIG. 3. Therefore, the tube power W (unit: W) is expressed by $W=k_3PI$ where E (unit: V) designates the tube voltage, I (unit: A) designates the tube current, P (unit: atmosphere) designates the rare gas charged pressure, and $k_3$ designates a proportionality factor. When the projecting length of each of the electrode rods is constant in the case where the electrode rod is formed to have a uniform thickness, the electrode temperature T can be specified (T=I/d) by the ratio I/d (unit: A/mm) of the magnitude I of the tube current to the outer diameter d of the electrode rod. Thus, the electrode temperature T is expressed by $T=W/(k_3Pd)$. That is, the electrode temperature T can be specified by the product Pd of the rare gas charged pressure P and the electrode rod outer diameter d on the condition that the tube power W is constant.

Then, as shown in FIG. 4, as for the heat deformation of the electrodes, there is no problem when the product Pd is in a range of 2.5 to 6.5, but any electrode may be possibly deformed when the product Pd is 2.0. On the other hand, as for arc fading-out, there is no problem when the product Pd is in a range of 1.5 to 5.0, but the arc may possibly fade out when the product Pd is in a range of 5.5 to 6.0, and surely fades out when the product Pd is not lower than 6.5.

In order to prevent the electrodes from being deformed by heat or to prevent the arc from fading out, it is therefore desired that the product Pd is in a range of 2.0 to 6.0, preferably in a range of 2.5 to 5.0.

BRIEF DESCRIPTION OF THE DRAWINGS

FIG. 2 is a table showing the results of operational tests carried out on arc tubes according to the first embodiment while the value of the ratio (I/d) of the magnitude of the tube current to the diameter of each electrode rod is changed;

FIG. 7 is a table showing the results of operational tests carried out on arc tubes according to the third embodiment while the value of the ratio (I/V) of the magnitude of the tube current to the volume of each electrode rod is changed;

DETAILED DESCRIPTION OF THE PREFERRED EMBODIMENTS

Next, the invention will be described on the basis of its embodiments.

FIGS. 1 to 4 show a first embodiment of the invention.

Figure 1:
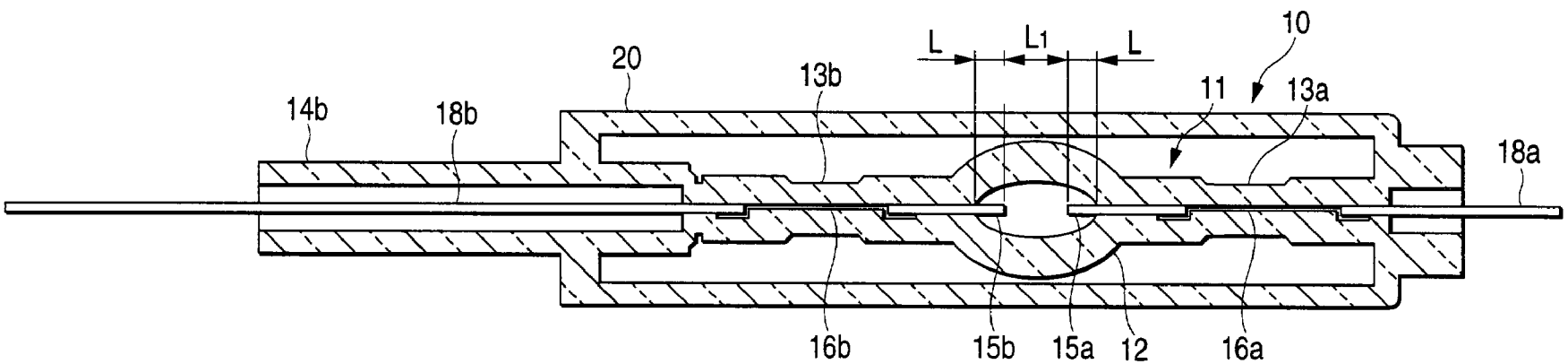
FIG. 1 is a longitudinal sectional view of a mercury-free arc tube for a discharge lamp unit according to a first embodiment of the invention.

In FIG. 1, the arc tube 10 has a structure in which cylindrical ultraviolet-shielding shroud glass 20 is integrally welded (sealed) to an arc tube body 11 having a closed glass bulb 12 provided with a pair of electrodes 15*a* and 15*b* opposite to each other so that the closed glass bulb 12 is surrounded by and sealed with the ultraviolet-shielding shroud glass 20.

The arc tube body 11 is processed from a circular pipe-shaped silica glass tube and has a structure in which the closed glass bulb 12 formed into a rotary elliptical shape is formed in a predetermined lengthwise position so as to be held between pinch seal portions 13*a* and 13*b* each shaped like a rectangle in cross section. Rectangular sheets of molybdenum foil 16*a* and 16*b* are sealed at the pinch seal portions 13*a* and 13*b* respectively. Tungsten electrodes 15*a* and 15*b* are provided in the closed glass bulb 12 so as to be opposite to each other. While the tungsten electrodes (hereinafter referred to as "electrode rods") 15*a* and 15*b* are connected to one side of the sheets of molybdenum foil 16*a* and 16*b* respectively, lead wires 18*a* and 18*b* led out of the arc tube body 11 are connected to the other sides of the sheets of molybdenum foil 16*a* and 16*b* respectively.

The cylindrical ultraviolet-shielding shroud glass 20 having an aperture larger than that of the closed glass bulb 12 is integrally welded to the arc tube body 11, so that a region from the pinch seal portions 13*a* and 13*b* of the arc tube body 11 to the closed glass bulb 12 is surrounded by the ultraviolet-shielding shroud glass 20 while a circular pipe-shaped rear extended portion 14*b* which is a non-pinch seal portion of the arc tube body 11 is protruded to the rear of the shroud glass 20. The shroud glass 20 is constituted by silica glass doped with $TiO_2$, $CeO_2$ and so on, and exhibiting an ultraviolet-shielding function. The shroud glass 20 is provided for surely cutting off ultraviolet rays in a predetermined wavelength range harmful to the human body from light emitted from the closed glass bulb 12 which is an electric discharge portion.

Starting rare gas, main light emitting metal halide and buffer metal halide are enclosed in the glass bulb 12. The charged pressure of the starting rare gas is set to be in a range of 8 to 20 atmospheres. Thus, a mercury-free arc tube which exhibits characteristics substantially equivalent to the characteristics of the related-art mercury-containing arc tube with no mercury enclosed is formed.

The main light emitting metal halide is a substance such as NaI and $ScI_3$ mainly contributing to light emission. The buffer metal halide is constituted by at least one kind of metal halide including halides of Al, Bi, Cr, Cs, Fe, Ga, In, Li, Mg, Ni, Nd, Sb, Sn, Ti, Tl, Tb, and Zn. The buffer metal halide acts as a buffer substance for suppressing a great reduction of the tube voltage in place of mercury enclosed in the related-art arc tube, and acts also as a light emitting substance substituted for mercury.

Further, a specific, non-limiting, configuration of the mercury-free arc tube will be described.

The internal volume of the closed glass bulb 12 is 20–50 μl, and the inter-electrode distance L1 is 4.0–4.4 mm. These values are equal to those in the related-art mercury-containing arc tube. In addition, it is desired that each of the electrode rods 15*a* and 15*b* has a uniform thickness in its lengthwise direction, with the projecting length L of 1–2 mm into the closed glass bulb, while the charged quantity of the main light emitting metal halide (NaI and $ScI_3$) is in a range of 0.1 mg to 0.6 mg, and the charged quantity of the buffer metal halide is in a range of $3\times10^{-4}$ mg/μl to $2\times10^{-2}$ mg/μl.

In addition, inert gas of 1 atmosphere or lower (0.5 atmospheres in the embodiment, as high as that in the related art) is enclosed between the arc tube body 11 and the shroud glass 20, so as to be designed to exhibit a heat insulating function against thermal radiation from the closed glass bulb 12 that is an electric discharge portion.

Then, the buffer metal halide (at least one kind of metal halide selected from the group including halides of Al, Bi, Cr, Cs, Fe, Ga, In, Li, Mg, Ni, Nd, Sb, Sn, Ti, Tl, Tb and Zn) enclosed in the closed glass bulb 12 restrains the tube voltage from being lowered greatly due to no mercury enclosed. Particularly, since the charged pressure of the starting rare gas is a pressure (8–20 atmospheres) higher than the charged pressure (3–6 atmospheres) in the related-art arc tube, the ratio at which electrons released from the electrode rods 15*a* and 15*b* as electric discharge collide with the molecules of rare gas increases. As a result, the temperature in the inside of the closed glass bulb 12 becomes high in operation (at electric discharge), so that the vapor pressure of the main light emitting metal halide and the vapor pressure of the buffer metal halide are made high. Accordingly, the tube voltage increases.

The buffer metal halide enclosed generates an emission color close to the emission color of mercury and acts to compensate for reduction in the quantity of emitted (white) light in a visible region and reduction in the luminous flux caused by no mercury enclosed. Particularly because the charged pressure of the rare gas is high (8 to 20 atmospheres), the temperature in the inside of the closed glass bulb 12 in operation (at electric discharge) is made high as described above. As a result, the vapor pressure of the buffer metal halide is made high, so that substantially the same whiteness (chromaticity) as the color of light emitted from the related-art mercury-containing arc tube can be obtained.

Figure 10:
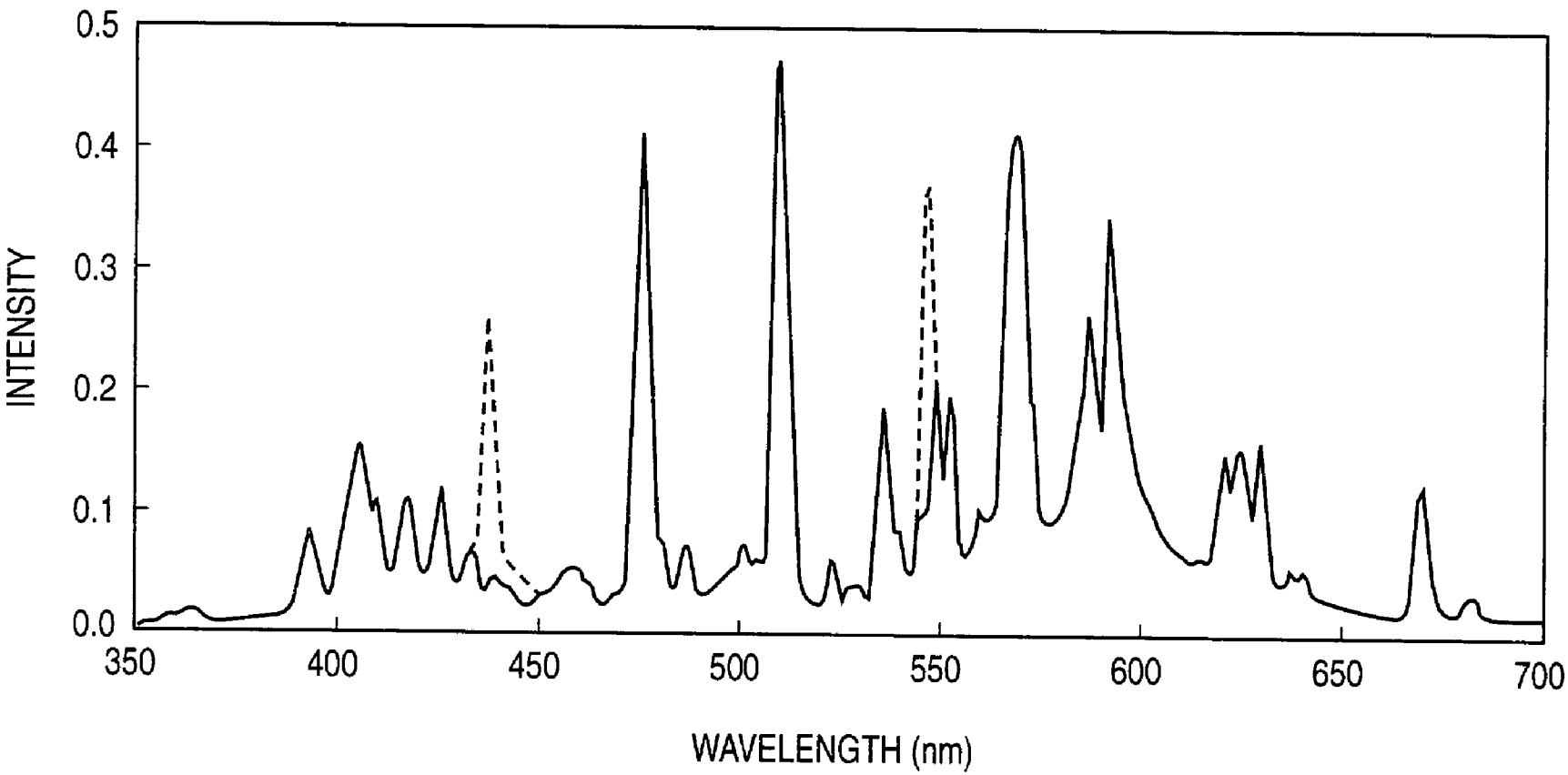
FIG. 10 is a graph showing the spectral characteristic of a mercury-free arc tube which contains main light emitting metal halide (NaI and $ScI_3$) and rare gas enclosed in a closed glass bulb.

The spectral characteristic of the mercury-free arc tube having no buffer metal halide enclosed makes a curve as represented by the solid line in FIG. 10. The spectral characteristic is short of intensity of light in wavelength ranges near to 435 nm and 546 nm compared with the spectral characteristic of the related-art mercury-containing arc tube. However, when the buffer metal halide is enclosed in the closed glass bulb 12 and the vapor pressure of the buffer metal halide is made high, substantially the same whiteness (chromaticity) as the color of light emitted from the related-art mercury-containing arc tube can be obtained because the intensity of light in wavelength ranges near to 435 nm and 546 nm increases to approach the intensity of light in wavelength ranges near to 435 nm and 546 nm in the spectral characteristic of the related-art mercury-containing arc tube (see the broken line in FIG. 10).

Because the charged pressure of the starting rare gas is high (8 to 20 atmospheres), the temperature in the inside of the closed glass bulb 12 in operation (at electric discharge) is made high as described above. As a result, the vapor pressure of the main light emitting metal halide (NaI and $ScI_3$) is made high, so that the luminous flux increases.

Because the charged pressure of the rare gas is high (8 to 20 atmospheres), the DC resistance component (impedance) at starting increases and the consumed electric power increases. As a result, the temperature of the closed glass bulb 12 in operation (at electric discharge) rises rapidly, so that the leading edge of luminous flux is made sufficient. That is, predetermined luminous flux can be obtained in a short time after the start of electric discharge.

When the temperature in the inside of the closed glass bulb 12 is made high, the center temperature of the arc rises. As a result, the center luminance of the arc increases, so that the luminous flux increases.

In addition, the inert gas in the closed space defined by the shroud glass 20 and surrounding the closed glass bulb 12 has a pressure of 1 atmosphere or lower (0.5 atmospheres in the embodiment, as high as that in the related art). Since the molecular density of the inert gas is low, it is difficult for the heat on the closed glass bulb 12 side to escape from the shroud glass to the outside through the closed space (inert gas layer). Thus, the temperature inside of the closed glass bulb 12 is kept high.

Accordingly, the vapor pressure of the main light emitting metal halide, the vapor pressure of the buffer metal halide and the vapor pressure of the rare gas in the closed glass bulb 12 are made high in operation (at electric discharge). As a result, the tube voltage, the luminous flux, the rising of the luminous flux, the chromaticity, and so on, are improved. Thus, a mercury-free arc tube having characteristics close to the characteristics of a related-art mercury-containing arc tube can be obtained.

On the other hand, when the buffer metal halide in place of mercury is simply enclosed in the closed glass bulb 12 together with the rare gas of high pressure (8–20 atmospheres), the tube voltage may not rise to be as high as that in the related-art mercury-containing arc tube. Therefore, on the condition that a larger tube current than the tube current supplied to the related-art mercury-containing arc tube is applied in this embodiment, the ratio I/d (unit: A/mm) of the magnitude I (unit: A) of the tube current to the outer diameter d (unit: mm) of each of the electrode rods 15*a* and 15*b* is set to be in a range of 1.0 to 5.0, preferably in a range of 3.0 to 5.0 so as to prevent the electrode temperature from staying out of optimum temperature and causing problems, for example, to prevent the glass from being cracked, the arc from fading out, the electrodes from being deformed, the glass bulb from turning black or the average lumen maintenance factor from being lowered.

That is, the temperature of each electrode is proportional to the current density and the electrode surface area. Accordingly, the electrode temperature T (unit: °C.) is expressed by $T=k_1(4I/\pi d^2)\pi dL=k_1LI/d$ where d (unit: mm) designates the outer diameter of the electrode rod 15*a* (15*b*), L (unit: mm) designates the projecting length of the electrode rod into the closed glass bulb, I (unit: A) designates the magnitude of the tube current, and $k_1$ designates a proportionality factor. Thus, when the projecting length L of the electrode rod 15*a* (15*b*) into the closed glass bulb 12 is constant, the electrode temperature T can be specified by the ratio I/d (unit: A/mm) of the magnitude I of the tube current to the outer diameter d of the electrode rod.

FIG. 2 shows the results of evaluation tests on arc tubes carried out by the inventor while the ratio (I/d) of the magnitude of the tube current to the diameter of each electrode rod is changed. The test results show how the rate of occurrence of cracks in the pinch seal portions 13*a* and 13*b*, the rate of occurrence of arc fading-out, the rate of occurrence of electrode deformation, the degree of turning-black of the glass bulb, and the lumen maintenance factor changed when each arc tube was operated for 1,500 hours by blinking in an EU car maker mode.

Incidentally, in each arc tube used in the tests of FIG. 2, NaI and $ScI_3$ ($NaI:ScI_3$=70:30 wt %) of 0.3 mg in total weight as main light emitting metal halide and $ZnI_2$ of 0.05 mg as buffer metal halide were enclosed in the closed glass bulb 12 together with Xe gas of 10 atmospheres in charged pressure.

As shown in FIG. 2, as for cracks occurring in the pinch seal portions 13*a* and 13*b*, no crack could be observed on any trial product when the ratio I/d was in a range of 0.5 to 5.0. Occurrence of cracks was observed on a part of the trial products when the ratio I/d was 5.5 . Occurrence of cracks was observed on all the trial products when the ratio I/d was not lower than 6.0.

As for the arc fading-out, no arc fading-out occurred in any trial product when the ratio I/d was in a range of 3.0 to 6.0. Arc fading-out occurred in a part of the trial products when the ratio I/d was in a range of 1.0 (inclusive) to 3.0 (exclusive), and occurred in all the trial products when the ratio I/d was not higher than 0.5.

As for the electrode deformation, no electrode deformation could be observed on any trial product when the ratio I/d was in a range of 0.5 to 5.0. However, electrode deformation was observed on all the trial products when the ratio I/d was not lower than 5.5.

As for the turning-black of the glass bulb, turning black of the glass bulb could not be observed in any trial product when the ratio I/d was in a range of 0.5 to 5.0. Turning black was observed in a part of the trial products when the ratio I/d was 5.5 , and observed in all the trial products when the ratio I/d was not lower than 6.0.

Further, as for the lumen maintenance factor, the average lumen maintenance factor was not lower than 70% when the ratio I/d was in a range of 0.5 to 5.0. However, the average lumen maintenance factor took a low value lower than 70% when the ratio I/d was not lower than 5.5.

Accordingly, in this embodiment, the ratio I/d is set to be in a range of 1.0 to 5.0, preferably in a range of 3.0 to 5.0. Thus, such problems as occurrence of cracks in the pinch seal portions, occurrence of fading-out of the arc, deformation of the electrodes, turning-black of the glass bulb, or lowering of the lumen maintenance factor are prevented.

Further, in this embodiment, the electrode temperature is controlled also by setting the product Pd of the charged pressure P (unit: atmosphere) of the starting rare gas (Xe gas) enclosed in the closed glass bulb 12 and the outer diameter d (unit: mm) of each of the electrode rods 15*a* and 15*b* to be in a range of 2.0 to 6.0, preferably in a range of 2.5 to 5.0.

Figures 3, 4:
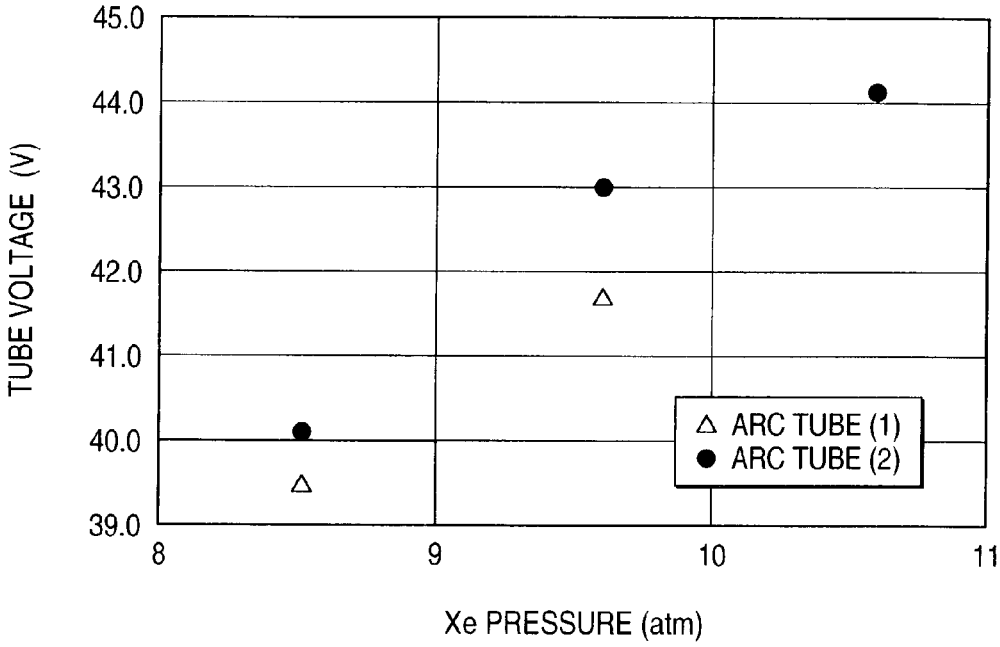
FIG. 3 is a graph showing the correlation between the rare gas charged pressure and the tube voltage.
FIG. 4 is a table showing the results of operational tests carried out on arc tubes according to the first embodiment while the value of the product (Pd) of the rare gas charged pressure and the diameter of each electrode rod is changed.

That is, the tube power is proportional to the tube voltage and the tube current, and the tube voltage and the charged pressure of the starting rare gas in the closed glass bulb have a correlation (proportionality) as shown in FIG. 3. Therefore, the tube power W (unit: W) is expressed by $W=k_3PI$ where E (unit: V) designates the tube voltage, I (unit: A) designates the tube current, P (unit: atmosphere) designates the charged pressure of rare gas, and $k_3$ designates a proportionality factor. When the projecting length L of each of the electrode rods is constant in the case where the electrode rod is formed to have a uniform thickness, the electrode temperature T can be specified (T=I/d) by the ratio I/d (unit: A/mm) of the magnitude I of the tube current to the outer diameter d of the electrode rod. Thus, the electrode temperature T is expressed by $T=W/(k_3Pd)$. That is, the electrode temperature T can be specified by the product Pd of the rare gas charged pressure P and the electrode rod outer diameter d on the condition that the tube power W is constant at stable electric discharge of the arc tube.

FIG. 4 shows the results of evaluation tests on arc tubes carried out by the inventor while the charged pressure of rare gas and the diameter of each electrode rod are changed. The test results show how the rate of occurrence of heat deformation of the electrodes and the rate of occurrence of arc fading-out changed. As shown in FIG. 4, as for the heat deformation of the electrodes, no deformation occurs when the product Pd is in a range of 2.5 to 6.5. Deformation may possibly occur when the product Pd is 2.0. On the other hand, as for the arc fading-out, no arc fading-out occurs when the product Pd is in a range of 1.5 to 5.0. Arc fading-out may possibly occur when the product Pd is in a range of 5.5 (inclusive) to 6.5 (exclusive), and the arc surely fades out when the product Pd is not lower than 6.5.

Accordingly, in this embodiment, the product Pd is set to be in a range of 2.0 to 6.0, preferably in a range of 2.5 to 5.0 so as to prevent the electrodes from being deformed by heat or the arc from fading out. In such a manner, in this embodiment, the electrode temperature is controlled by both the ratio I/d (unit: A/mm) of the magnitude I (unit: A) of the tube current to the outer diameter d (unit: mm) of each electrode rod 15*a,* 15*b* and the product Pd of the charged pressure P of Xe gas enclosed in the closed glass bulb 12 and the outer diameter d (unit: mm) of each electrode rod 15*a,* 15*b.*

Figure 5:
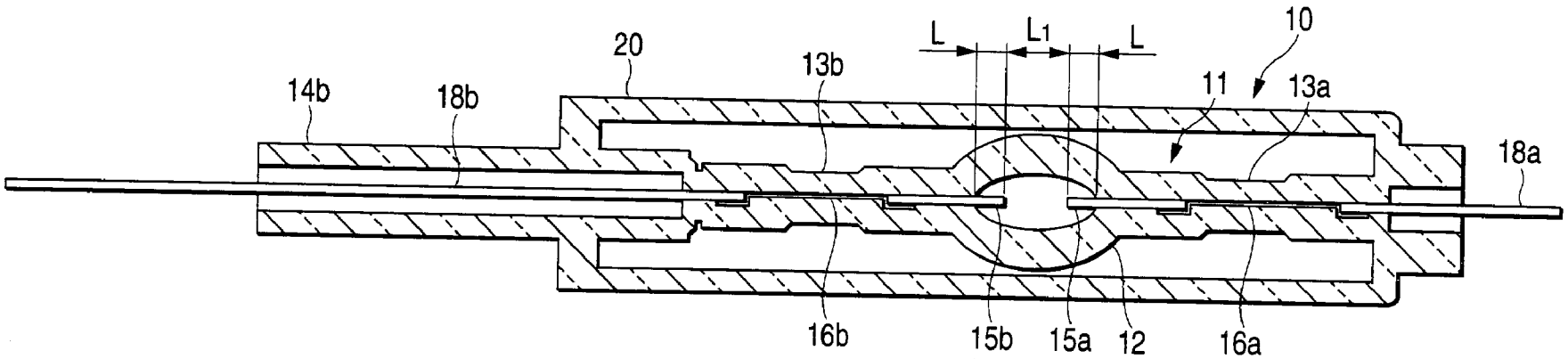
FIG. 5 is a longitudinal sectional view of a mercury-free arc tube for a discharge lamp unit according to a second embodiment of the invention.

FIG. 5 is a longitudinal sectional view of a mercury-free arc tube for a discharge lamp unit according to a second embodiment of the invention, with exactly the same contour structure such as dimensions as the structure of the first embodiment.

That is, main light emitting metal halide, buffer metal halide, and starting rare gas are enclosed in the closed glass bulb 12 in the arc tube according to the first embodiment. On the other hand, the arc tube according to the second embodiment has a structure in which main light emitting metal halide and starting rare gas (of 8–20 atmospheres in charged pressure) are enclosed in the closed glass bulb 12 while inert gas (of 0.5 atmospheres) not higher than 1 atmosphere is enclosed in a closed space surrounding the arc tube body 11. Accordingly, no buffer metal halide is enclosed in the closed glass bulb 12.

Then, NaI and $ScI_3$ are used as the main light emitting metal halide enclosed in the closed glass bulb 12 in the same manner as in the first embodiment. However, the total weight of NaI and $ScI_3$ is, for example, 0.1 mg, smaller than that in the first embodiment (total weight 0.3 mg). The ratio of NaI to $ScI_3$ is, for example, NaI:$ScI_3$=75:25 wt %, in which the ratio of NaI is higher than that in the first embodiment (NaI:$ScI_3$=70:30 wt %). On the other hand, the charged pressure of Xe gas as the starting rare gas is, for example, 12 atmospheres, higher than that in the first embodiment (10 atmospheres). The other constituent parts are the same as those of the arc tube in the first embodiment, and referred to as the same numerals as in the first embodiment for the sake of omission of duplicate description.

Then, the ratio I/d (unit: A/mm) of the magnitude I (unit: A) of the tube current to the outer diameter d (unit: mm) of each electrode rod 15*a,* 15*b* is set to be in a range of 1.0 to 5.0, preferably in a range of 3.0 to 5.0, in the same manner as in the first embodiment, so as to prevent problems, for example, to prevent the glass in the pinch seal portions from being cracked, the arc from fading out, the electrodes from being deformed, the glass bulb from turning black or the lumen maintenance factor from being lowered.

Further, the product Pd of the charged pressure P (unit: atmosphere) of the starting rare gas (Xe gas) enclosed in the closed glass bulb 12 and the outer diameter d (unit: mm) of each electrode rod 15*a,* 15*b* is set to be in a range of 2.0 to 6.0, preferably in a range of 2.5 to 5.0 in the same manner as in the first embodiment, so as also to prevent the electrodes from being deformed by heat or the arc from fading out.

That is, in the second embodiment, the charged quantity and ratio (mass ratio of NaI to $ScI_3$) of the main light emitting metal halide (NaI and $ScI_3$) and the charged pressure of the starting rare gas (Xe gas) enclosed in the closed glass bulb 12 are adjusted to be different from those in the first embodiment. Thus, the vapor pressure of the main light emitting metal halide and the vapor pressure of the rare gas in the closed glass bulb 12 are made high in operation (at electric discharge). As a result, the tube voltage, the luminous flux, the rising of the luminous flux, the chromaticity, and so on, are improved. Thus, a mercury-free arc tube having characteristics close to the characteristics of a related-art mercury-containing arc tube can be obtained. In addition, it has been confirmed that the mercury-free arc tube obtained thus satisfies the characteristics shown in FIGS. 2 and 4.

Figure 6:
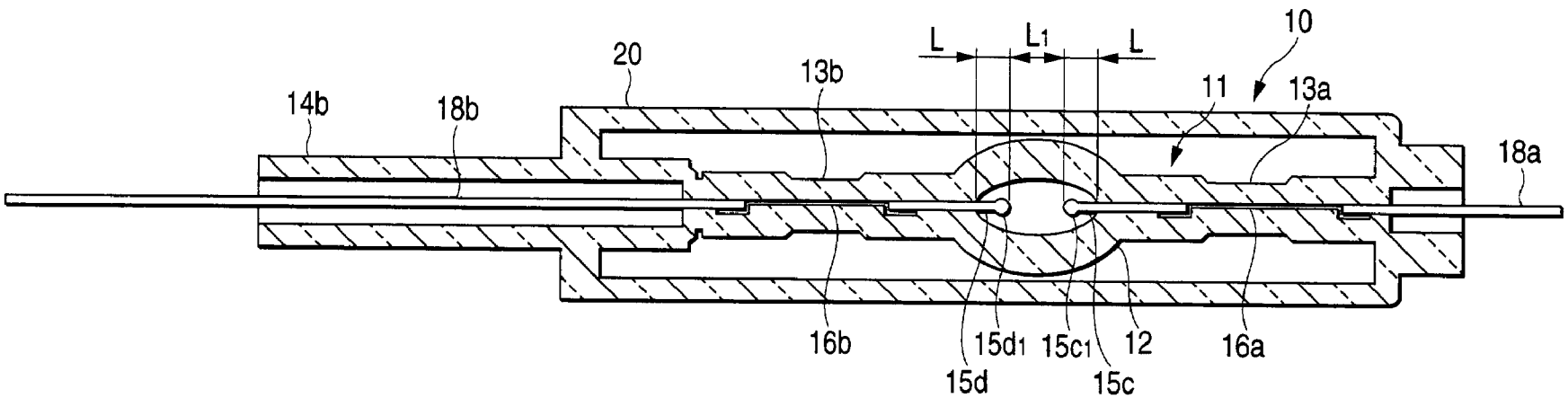
FIG. 6 is a longitudinal sectional view of a mercury-free arc tube for a discharge lamp unit according to a third embodiment of the invention.

FIGS. 6 and 7 show a third embodiment of the invention. FIG. 6 is a longitudinal sectional view of a mercury-free arc tube for a discharge lamp unit according to the third embodiment. FIG. 7 is a table showing the results of operational tests which are carried out while the ratio (I/V) of the magnitude of the tube current to the volume of each electrode rod is changed.

In the first and second embodiments, each electrode rod 15*a,* 15*b* was formed into a shape having a uniform thickness in its lengthwise direction. Each electrode rod 15*c,* 15*d* in the third embodiment is, however, formed into a shape having a spherical portion 15*c*1, 15*d*1 at its front end. The spherical portion 15*c*1, 15*d*1 has a larger diameter than the shaft diameter of the electrode rod 15*c,* 15*d.*

On the condition that a larger tube current than the tube current supplied to the related-art mercury-containing arc tube is applied also in the third embodiment, the ratio I/V (unit: A/$mm^3$) of the magnitude I (unit: A) of the tube current to the volume V (unit: $mm^3$) of each electrode rod 15*c* (15*d*) in the closed glass bulb 12 is set to be in a range of 1.0 to 10 so as to prevent the electrode temperature from staying out of optimum temperature and causing problems, for example, to prevent the glass from being cracked, the arc from fading out, the electrodes from being deformed, the glass bulb from turning black or the average lumen maintenance factor from being lowered. The other constituent parts are the same as those in the first embodiment. Thus, only the different points will be described while the same constituent parts are referred to as the same numerals as in the first embodiment for the sake of omission of duplicate description.

When each electrode rod is formed not to have a uniform thickness as the electrode rod 15*c,* 15*d* shown in this embodiment, in which a spherical portion having a larger diameter than the shaft diameter thereof is formed at the front end thereof, the relationship of $T=4k_1LI/d$ applied to the first embodiment is not established. In such a case, however, the electrode temperature is proportional to the tube current, but inversely proportional to the electrode volume. Accordingly, the electrode temperature T (unit: °C.) satisfies the relationship of $T=k_2I/V$ where V (unit: $mm^3$) designates the volume of each electrode rod in the closed glass bulb, I (unit: A) designates the magnitude of the tube current, and $k_2$ designates a proportionality factor. Thus, the electrode temperature T can be specified by the ratio I/V (unit: A/$mm^3$) of the tube current magnitude I to the electrode rod volume V.

FIG. 7 shows the results of evaluation tests on arc tubes carried out by the inventor while the ratio (I/V) of the magnitude of the tube current to the diameter of each electrode rod is changed. The test results show how the rate of occurrence of arc fading-out, the rate of occurrence of electrode deformation, the degree of turning-black of the glass bulb, and the lumen maintenance factor changed when each arc tube was operated for 1,500 hours by blinking in an EU car maker mode.

As shown in FIG. 7, as for the arc fading-out, no arc fading-out occurred in any trial product when the ratio I/V was in a range of 1.0 to 100. Arc fading-out occurred in a part of the trial products when the ratio I/V was in a range of 0.2 (inclusive) to 1.0 (exclusive), and occurred in all the trial products when the ratio I/V was not higher than 0.1.

Further, as for the electrode deformation, no electrode deformation was observed in any trial product when the ratio I/V was in a range of 0.1 to 25, but electrode deformation was observed in a part of the trial products when the ratio I/V was in a range of 50 (inclusive) to 100 (exclusive), and observed in all the trial products when the ratio I/V was not lower than 100.

Further, as for the turning-black of the glass bulb, the glass bulb did not turn black in any trial product when the ratio I/V was in a range of 0.2 to 10. However, the glass bulb turned black in a part of the trial products when the ratio I/V was lower than 0.2, or in a range of 25 to 75, and turned black in all the trial products when the ratio I/V was not lower than 100.

Further, as for the lumen maintenance factor, the average lumen maintenance factor was not lower than 70% when the ratio I/V was in a range of 0.1 to 75, but the average lumen maintenance factor took a low value lower than 70% when the ratio I/V was not lower than 100.

Accordingly, when the ratio I/V is in a range of 1.0 to 10, there is no fear that the electrode temperature becomes extremely low or extremely high. Thus, such a problem as occurrence of cracks in the glass of the pinch seal portions, occurrence of fading out of the arc, deformation of the electrodes, turning-black of the glass bulb, or lowering of the lumen maintenance factor does not exist at all.

Figure 8:
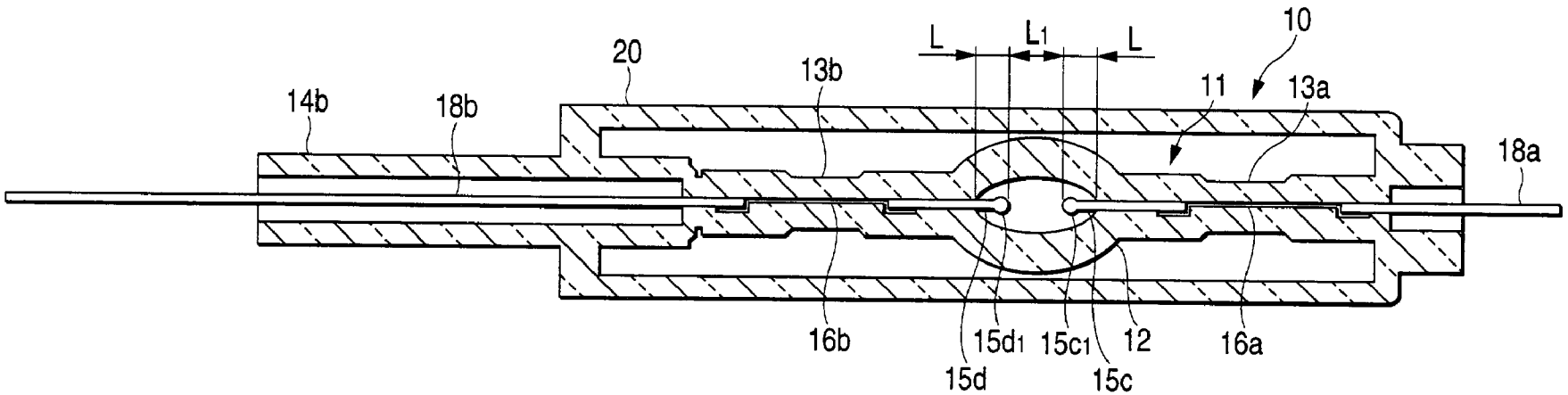
FIG. 8 is a longitudinal sectional view of a mercury-free arc tube for a discharge lamp unit according to a fourth embodiment of the invention.
Figure 9:
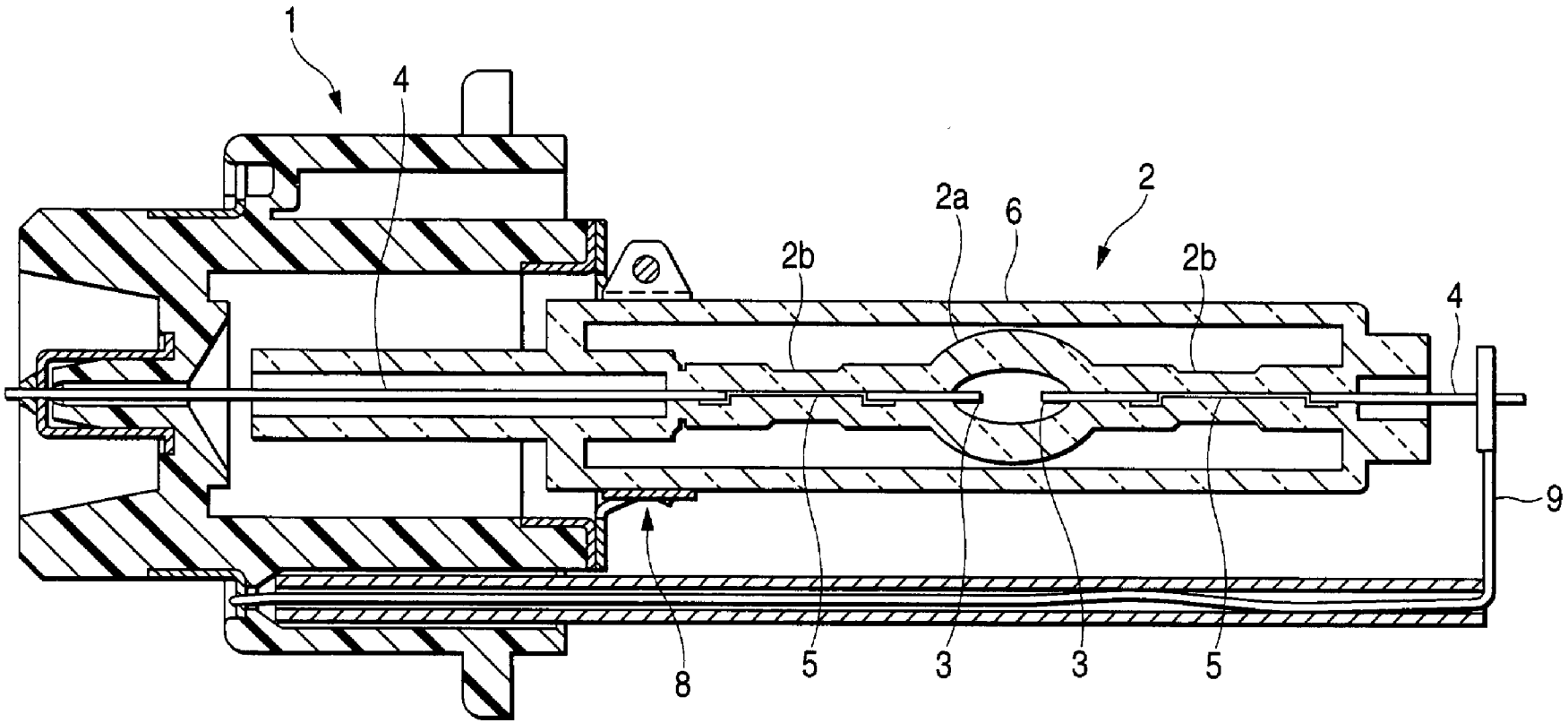
FIG. 9 is a longitudinal sectional view of a related-art discharge lamp unit.

FIG. 8 is a longitudinal sectional view of a mercury-free arc tube for a discharge lamp unit according to a fourth embodiment of the invention, with exactly the same contour structure such as dimensions as the structure of the third embodiment.

That is, main light emitting metal halide, buffer metal halide, and starting rare gas are enclosed in the closed glass bulb 12 in the arc tube according to the third embodiment. On the other hand, the arc tube according to the fourth embodiment has a structure in which main light emitting metal halide and starting rare gas (of 8–20 atmospheres in charged pressure) are enclosed in the closed glass bulb 12 while inert gas (of 0.5 atmospheres) not higher than 1 atmosphere is enclosed in a closed space surrounding the arc tube body 11. Accordingly, no buffer metal halide is enclosed in the closed glass bulb 12. The other constituent parts are the same as those in the arc tube according to the third embodiment, and referred to as the same numerals as in the third embodiment for the sake of omission of duplicate description.

That is, in the fourth embodiment, the charged quantity and ratio of the main light emitting metal halide (NaI and $ScI_3$) and the charged pressure of the starting rare gas (Xe gas) enclosed in the closed glass bulb 12 are adjusted to be different from those in the third embodiment. Thus, the vapor pressure of the main light emitting metal halide and the vapor pressure of the rare gas in the closed glass bulb 12 are made high in operation (at electric discharge). As a result, the tube voltage, the luminous flux, the rising of the luminous flux, the chromaticity, and so on, are improved. Thus, a mercury-free arc tube having characteristics close to the characteristics of the related-art mercury-containing arc tube can be obtained. In addition, it has been confirmed that the mercury-free arc tube obtained thus satisfies the characteristics shown in FIG. 7.

As is apparent from the description, when a mercury-free arc tube for a discharge lamp unit according to the invention is used, predetermined buffer metal halide in place of mercury is enclosed in a closed glass bulb in accordance with necessity, and the tube current is increased to obtain a tube voltage close to the tube voltage of the related-art arc tube. In either the case where the buffer metal halide is enclosed or the case where the buffer metal halide is not enclosed, the ratio I/d (unit: A/mm) of the magnitude I of the tube current to the diameter d of each electrode rod or the ratio I/V (unit: $A/mm^3$) of the magnitude I of the tube current and the volume V of each electrode rod is set to be in a predetermined range. In such a configuration, the electrodes are kept in optimum temperature (optimum temperature to prevent the glass from being cracked, the arc from fading out, the electrodes from being deformed, the glass bulb from turning black, or the lumen maintenance factor from being lowered). Thus, an environmentally friendly mercury-free arc tube having characteristics substantially equivalent to the characteristics of the related-art mercury-containing arc tube can be obtained.

In addition, according to the invention, there are many options to select the quantity or ratio of the metal halide enclosed in the closed glass bulb, and so on. Thus, mercury-free arc tubes having many different characteristics can be provided.

Further, according to the invention, the electrode temperature is controlled also by the product of the charged pressure of starting rare gas enclosed in the closed glass bulb and the outer diameter of each electrode rod. Accordingly, the electrodes are surely kept in optimum temperature (optimum temperature to prevent the glass from being cracked, the arc from fading out, the electrodes from being deformed, the glass bulb from turning black, or the lumen maintenance factor from being lowered). Thus, an environmentally friendly mercury-free arc tube having characteristics substantially equivalent to the characteristics of the related-art mercury-containing arc tube can be obtained.

Further, when the electrode temperature T is controlled by the ratio I/d (unit: A/mm) of the magnitude I of the tube current to the outer diameter d of each electrode rod, the magnitude I of the tube current is a factor that cannot be obtained accurately if the trial products are not really made to discharge electricity. It is therefore necessary to design the arc tube in consideration of such an uncertain part. On the other hand, when the electrode temperature T is controlled by the product Pd of the rare gas charged pressure P and the electrode rod outer diameter d, the electrode temperature T can be specified without producing trial products on the condition that the tube power (rated value 35 W) of an automobile discharge lamp unit (discharge bulb) is constant. It therefore becomes easier to design the arc tube.

What is claimed is:

1. A mercury-free arc tube for a discharge lamp unit comprising:

a closed glass bulb held between pinch seal portions located at opposite ends of said closed glass bulb; and a pair of electrode rods provided in said closed glass bulb so as to be opposite to each other, said closed glass bulb including main light emitting metal halide and starting rare gas enclosed in said closed glass bulb, and said pair of electrode rods respectively having an outer diameter d which is constant along the entire length of the electrode rods;

wherein an outer diameter d of each of said electrode rods and a tube current I supplied to said electrode rods satisfy a relationship of $1.0 \leqq I/d \leqq 5.0$, wherein "I" is in amperes and "d" is in millimeters, wherein each of said electrode rods has the same outer diameter d, wherein a charged pressure P of said starting rare gas enclosed in said closed glass bulb and the outer diameter d of each of said electrode rods satisfy a relationship of $2.0 \leqq P \cdot d \leqq 6.0$, wherein "P" is in atmosphere, and said pair of electrode rods include portions that extend into the closed glass bulb, wherein a volume V of each of said portions of said electrode rods that extends into said closed glass bulb and a tube current I supplied to said electrode rods satisfy a relationship of $1.0 \leqq I/V \leqq 10.0$, wherein "V" is in cubic millimeters.

2. The mercury-free arc tube for a discharge lamp unit according to claim 1, wherein buffer metal halide comprising one or more halides including Al, Bi, Cr, Cs, Fe, Ga, In, Li, Mg, Ni, Nd, Sb, Sn, Ti, Tl, Tb and Zn is enclosed in said closed glass bulb.

3. The mercury-free arc tube for a discharge lamp unit according to claim 1, wherein a charged pressure P of said starting rare gas enclosed in said closed glass bulb and the outer diameter d of each of said electrode rods satisfy a relationship of $2.5 \leqq P \cdot d \leqq 5.0$.

4. A mercury-free arc tube for a discharge lamp unit comprising:

a closed glass bulb held between pinch seal portions located at opposite ends of said closed glass bulb; and a pair of electrode rods provided in said closed glass bulb so as to be opposite to each other, said closed glass bulb including main light emitting metal halide and starting rare gas enclosed in said closed glass bulb, said pair of electrode rods include portions that extended into the closed glass bulb, wherein a volume V of each of said portions of said electrode rods that extends into said closed glass bulb and a tube current I supplied to said electrode rods satisfy a relationship of $1.0 \leqq I/V \leqq 10.0$, wherein "I" is in amperes and "V" is in cubic millimeters, wherein each of said portions of said electrode rods has a front end and a shaft, and each of the front ends of said electrode rods has a larger outer diameter than an outer diameter d of the shaft of said electrode rods, and wherein a charged pressure P of said starting rare gas enclosed in said closed glass bulb and the outer diameter d of each of the shafts of said electrode rods satisfy a relationship of $2.0 \leqq P \cdot d \leqq \mathbf{6.0}$, wherein "P" is in atmospheres and "d" is in millimeters.

5. The mercury-free arc tube for a discharge lamp unit according to claim 4, wherein buffer metal halide comprising one or more halides including Al, Bi, Cr, Cs, Fe, Ga, In, Li, Mg, Ni, Nd, Sb, Sn, Ti, Tl, Tb and Zn is enclosed in said closed glass bulb.

6. The mercury-free arc tube for a discharge lamp unit according to claim 4, wherein a charged pressure P of said starting rare gas enclosed in said closed glass bulb and an outer diameter d of each of said electrode rods satisfy a relationship of $2.5 \leqq P \cdot d \leqq 5.0$.

* * * * *